US006553802B1

(12) United States Patent
Jacob

(10) Patent No.: US 6,553,802 B1
(45) Date of Patent: Apr. 29, 2003

(54) ELECTRONIC KEY, ESPECIALLY FOR MOTOR VEHICLES

(75) Inventor: Dirk Jacob, Heiligenhaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/868,052

(22) PCT Filed: Nov. 29, 1999

(86) PCT No.: PCT/EP99/09251

§ 371 (c)(1),
(2), (4) Date: Jun. 13, 2001

(87) PCT Pub. No.: WO00/36252

PCT Pub. Date: Jun. 22, 2000

(30) Foreign Application Priority Data

Dec. 16, 1998 (DE) ..... 198 58 165

(51) Int. Cl.[7] ..... E05B 65/12

(52) U.S. Cl. ..... 70/456 R; 70/257; 70/256; 70/278.1; 70/277; 70/279.1; 70/283; 70/283.1; 70/408; 70/459

(58) Field of Search ..... 70/257, 256, 278.1, 70/278.2, 278.3, 277, 279.1, 283, 283.1, 408, 414, 456 R, 459, 460

(56) References Cited

U.S. PATENT DOCUMENTS 4,941,569 A * 7/1990 Lindmayer et al. ..... 206/38.1
5,768,925 A * 6/1998 Ozawa et al. ..... 70/408
5,870,917 A * 2/1999 Mahot et al. ..... 70/408
6,216,501 B1 * 4/2001 Marquardt et al. ..... 70/252
6,314,775 B2 * 11/2001 Schwab ..... 70/456 R
6,318,137 B1 * 11/2001 Chaum ..... 70/278.3
6,386,007 B1 * 5/2002 Johnson et al. ..... 70/408

FOREIGN PATENT DOCUMENTS

DE 4444913 6/1995
DE 4444913 A1 * 6/1995 ..... E05B/19/06
DE 297 22 484 U1 4/1998
DE 19723039 A1 * 12/1998 ..... E05B/19/00

* cited by examiner

*Primary Examiner*—Anthony Knight
*Assistant Examiner*—Christopher Boswell
(74) *Attorney, Agent, or Firm*—Friedrich Kueffner

(57) ABSTRACT

The invention relates to an electronic key comprising electronic components for receiving or transmitting signals. Said components are integrated in a housing (20). A mechanical emergency key (30') is provided in case of an electronics failure. Said emergency key (30') can be inserted into a recess (27) in the housing (20) together with its key shaft (31'). The aim of the invention is to produce a key which can be handled easily. To this end, one end of the housing is provided with a recess which is undercut at least in places and which usually prevents the inserted emergency key (30') from being pulled out. Usually, the key is in a holding position in the housing (20) with an essentially positive fit. However, the emergency key can be turned in the recess (27) of the housing (20) from a holding position to a release position (30') in which the positive fit between the widening (32') in the key (30') and the recess is eliminated in the pull-out direction of the emergency key.

17 Claims, 5 Drawing Sheets

FIG. 7

ELECTRONIC KEY, ESPECIALLY FOR MOTOR VEHICLES

BACKGROUND OF THE INVENTION

1. Field of the Invention

The invention relates to a key, in particular, for motor vehicles, comprising a housing which receives and contains electronic components for sending or receiving signals for activating a corresponding electronic or electromechanical lock, and comprising a mechanical emergency key which is insertable with a key shaft into a receptacle of the housing and is secured in the insertion situation in the housing, wherein the emergency key is provided with a widened portion. It is not only embodied as an electronic key but also comprises a mechanical emergency key. The emergency key serves for mechanically opening the lock if the electronic device fails.

2. Description of the Related Art

In keys known from DE 29722 484 U1, the housing of the electronic key has a receptacle for the emergency key. When it is to be used, the emergency key can be gripped at a widened portion or the like functioning as a key head. A problem resides in that the insertion position of the emergency key in the receptacle is to be secured. However, this securing action should not impair handling of the emergency key during insertion and removal.

DE 44 44 913 A1 discloses a mechanical emergency key which is inserted into the interior of the housing of an electronic key. For securing the insertion position, an additional locking element for the emergency key in the receptacle is shown so that the emergency key is captively secured in the receptacle. In order to remove the key from the receptacle, the locking element, for example, a two-arm lever or a spring tongue, must be manually released beforehand by means of a pushbutton. This securing action of the emergency key is realized by additional locking elements and is thus complex.

SUMMARY OF THE INVENTION

It is an object of the invention to provide a key which can be easily handled and which is secured reliably in the housing in the insertion position. This is achieved according to the invention in that one housing end has a cutout which is undercut at least over portions thereof and normally, with the emergency key inserted, prevents its pulling-out movement, wherein the key head is positioned inside the housing in a substantially positive-locking securing position, and that the emergency key in the receptacle (blind hole) of the housing can be rotated out of this securing position into a release position in which the positive locking action between the widened portion and the cutout is released in the direction of the pulling-out movement of the emergency key.

The widened portion of the key serves expediently also as a grip portion of the emergency key and is, in general, a key head. It is understood that such a widened portion must not have the function of a grip portion of the emergency key. For reasons of simplicity, in the following the widened portion is, however, to be referred to as the key head. With respect to the housing the key head can be moved between two rotationally displaced positions, i.e., a securing position in which it is secured in the housing and a release position in which it can be removed from the housing. In the securing position, a positive-locking securing is provided where the widened portion or the key head is positioned at least partially in a cutout of one housing end. In the securing position it is not possible to pull the emergency key out of the housing. Removal is, however, quickly and easily possible because the key head is not covered by the housing in a direction substantially perpendicular to the plane of the cutout and can be moved into the release position that is rotated relative thereto. This movement is carried out as a rotation about a rotational axis extending in the longitudinal direction of the key shaft. In the release position the key head is no longer positive-lockingly secured. Now a translatory movement of the emergency key in the direction of pulling it out is possible. The pulling out of the emergency key from the housing in the release position is thus carried out in a rotationally displaced plane relative to the position between the housing and the key head provided in the securing position.

This movement of the components during coupling and decoupling can be described as a righting movement. The widened portion of the key or the key head used for handling the key can have a sufficiently large surface without endangering the safety function in the securing position. Accordingly, handling during coupling as well as decoupling and, finally, for actuating the key is facilitated. This holds true especially-when the key head and the housing are plate-like which ensures in the securing position a flush transition of the outer surfaces of these components. Disruptive edges or projections are not present. Accordingly, the storage of the key in pant pockets of the user is particularly comfortable.

BRIEF DESCRIPTION OF THE DRAWINGS

Further measures and advantages of the invention result from the dependent claims, the following description, and the drawings. In the drawings the invention is illustrated in the form of one embodiment. It is shown in:

DESCRIPTION OF THE PREFERRED EMBODIMENTS

Figure 4:
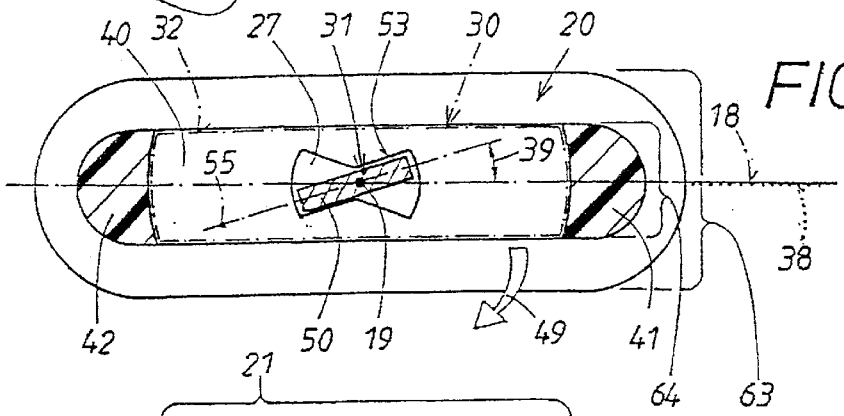
Figure 8:
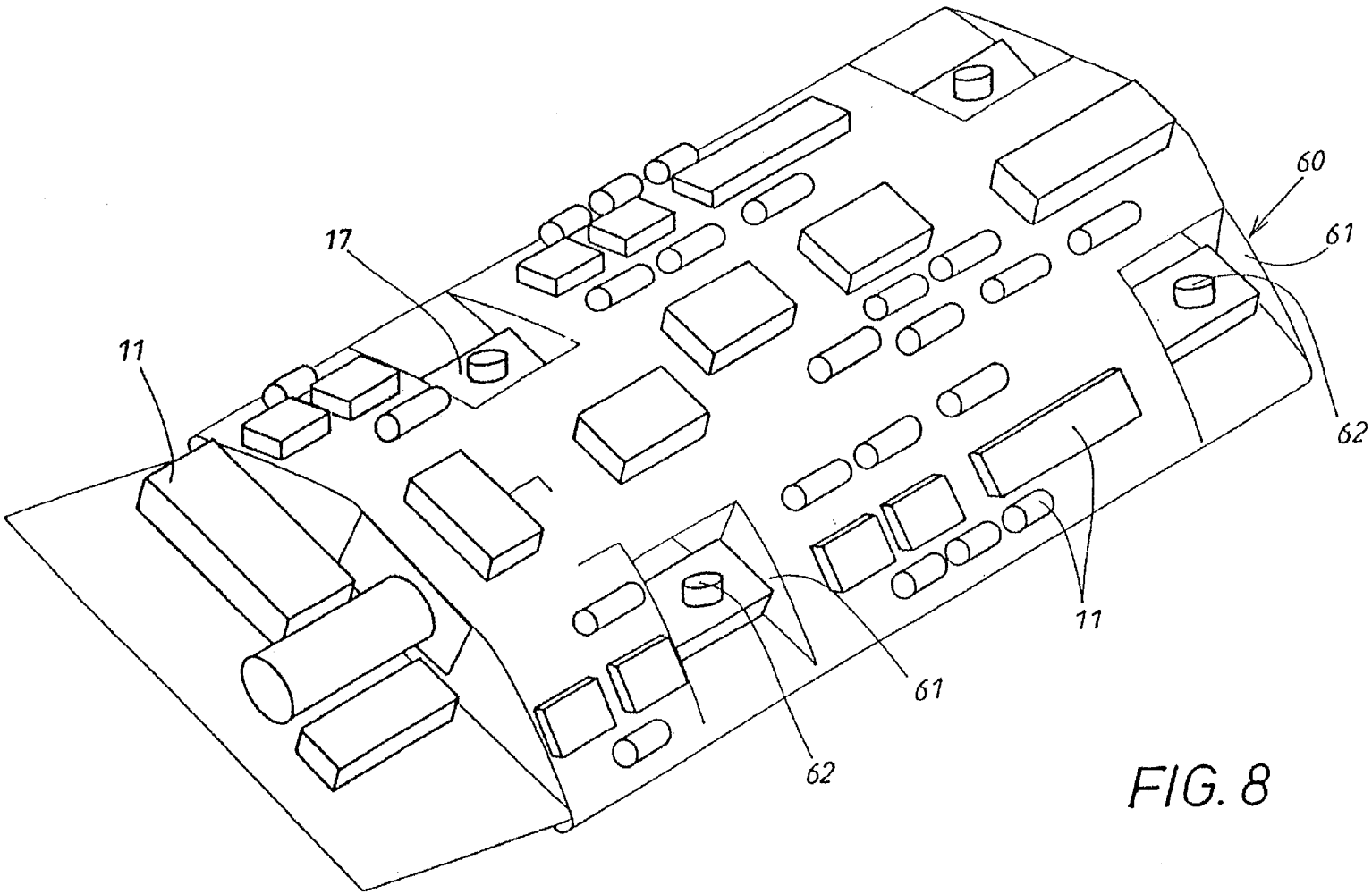
FIG. 8 in a perspective stretched position the flexible circuit board for receiving electronic components which are housed in the housing in a folded state.

The key according to the invention comprises a combination of the actual electronic key 10 and the mechanical emergency key 30. The electronic key 10 can act across a larger distance onto a lock, not illustrated in detail, arranged on a vehicle by encoded signals 15. For this purpose, the housing 20, which can be comprised of several housing parts 21 to 24, has suitable electronic components 11 and actuating locations 13, 14 which generate this signal 15 and, optionally in dialogue, conduct it further to the corresponding complementary sending and receiving unit in the vehicle. In the successful situation, i.e., when the code of the signal 15 has been accepted, an electronic or electromechanical lock, not illustrated in detail, is activated. In the area of this actuation location 11 to 14, micro switches 17 are arranged which have switching members 62 illustrated in FIG. 8. They are seated, together with the components 11, on a foil 60, preferably also comprising electric conductor strips, which foil is illustrated in FIG. 8. This foil 60 can have at portions thereof depressions 61 in which some of the elements 11 or members 62 can be arranged in a recessed way. The foil 60 can be folded and can be housed in a more or less cylindrical space in the interior of the housing 20. The housing 20 is configured with longitudinal symmetry relative to the longitudinal center 16 illustrated in FIG. 1. The housing 20 is plate-shaped as can be seen at 63 in. FIG. 4 and determines a center plane 18 illustrated in FIG. 4 in a dash-dotted line.

Figure 7:
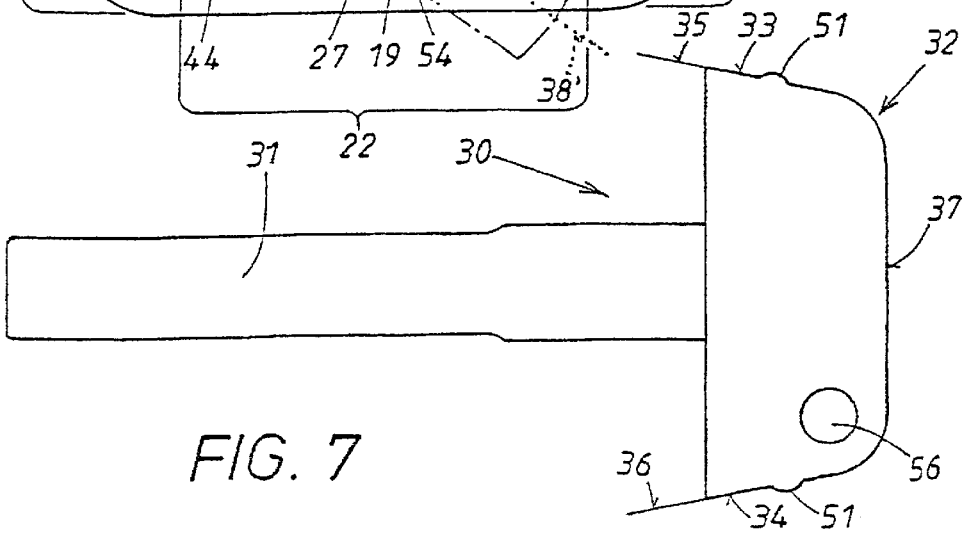
FIG. 7 in a plan view the emergency key removed from the housing.

The basic configuration of the emergency key 30 can be taken from FIG. 7. It comprises a key shaft 31 with profiled cuts or tracks, not illustrated in detail, for corresponding control means in the lock. At its outer end a widened portion is provided which can be a unitary part or a separate part relative to the key shaft 31. In the present case, it is a key head 32 of plastic material. The key shaft 31 has a flat profile 50 which is preferably comprised of metal. The key head 32 also defines a center plane 38 which is illustrated by the dotted line 38 in FIG. 4. The flat profile 50 of the key shaft 31, as can be seen in FIG. 4, is rotated relative to the preferably symmetrical cross-sectional profile of the key head 32, as illustrated by the dash-dotted cross-sectional plane 50, by an angle 39 relative to this center plane 38. The contour of the housing 20 as well as that of the key head 32 are plate-shaped 63, 64, according to FIG. 4, but can also be provided with profiles within. Normally, the emergency key 30 is in its rest position illustrated in FIGS. 1 through 4, which in the following is referred to as "securing position" of the emergency key. In this case, the center plane 18 of the housing 20 is substantially at the same level as the center plane 38 of the key head 32.

Figure 6:
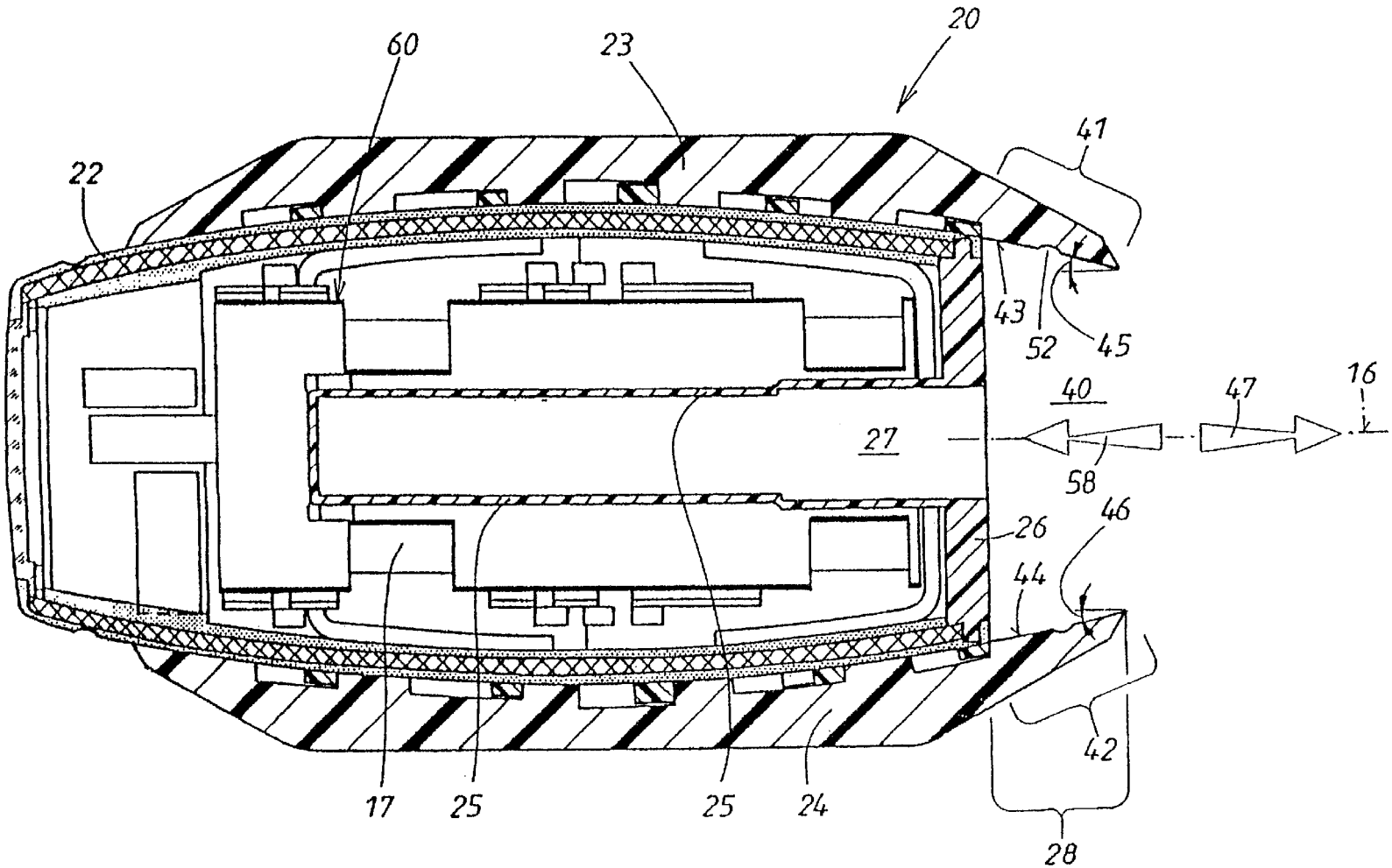
FIG. 6 a representation corresponding to FIG. 2 after the emergency key has been removed from the housing.

As can be seen best in FIG. 6, the rearward housing end 28 has a cutout 40 which is formed here as a fork opening. Accordingly, fork legs 41, 42 result which delimit the cutout 40. The end wall 26 which delimits the cutout. 40 in the inward direction is provided with a receptacle 27 for the already described key shaft 31 of the emergency key 30 when the securing position 30 according to FIGS. 1 through 4 is present. The receptacle 27 is formed here by a quiver 25 which is a unitary part of the end wall 26 which forms an inner housing and is positioned in this embodiment in the already aforementioned longitudinal center 16 of the housing 20. In the holding position according to FIGS. 1 through 4, the emergency key 30 is initially secured in an insertion position in the receptacle 27 and cannot be pulled out without effort in the direction of arrow 47 of FIG. 2. For this purpose, the following measures are proposed.

Figure 3:
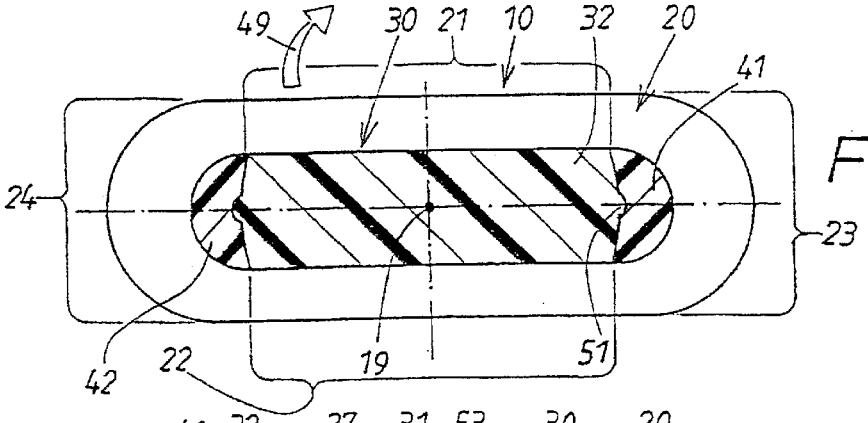
FIGS. 3+4 two cross sections of the housing of FIGS. 1 and 2 along the section line III—III and IV—IV, respectively.
Figure 5:
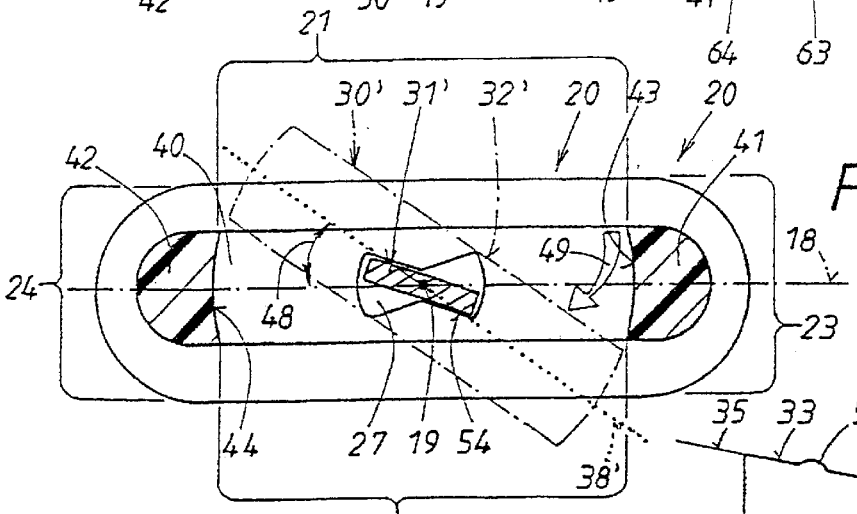
FIG. 5 the position of the components of FIG. 4 in another rotationally displaced position in a representation corresponding to FIG. 4.

The cutout 40 is at least partially undercut at 43, 44. In the present situation, this is achieved on the two legs 41, 42 by more or less convergently extending inner surfaces 43, 44 of the two legs 41, 42. By this measure, at least at certain points there is positive locking interaction between the legs 41, 42 generating an undercut 45, 46 according to FIG. 6, on the one hand, and the key head 32, on the other hand. In this securing position the key head 32 is in a position as flush as possible relative to the housing 20 which can be seen by the already mentioned coinciding levels of the center planes 18, 38 of the two plate shapes 63, 64 of FIG. 4. As an additional securing action of the securing position of FIGS. 1 through 4, interacting locking elements 51, 52 can be provided at the contact locations of the legs 41, 42 and in the circumferential area, for example, a projection 51 and a depression 52, as can be seen in FIGS. 3 and 5. This requires a kind of righting connection in order to be able to pull the emergency key 30 out of the housing 20 in the direction of arrow 47. This will be explained with the aid of FIG. 5 in more detail.

The cutout 40 in the housing 20 is open in the upward and downward directions so that a rotation of the key head from the securing position in the direction of arrow 49 of FIGS. 3 through 5 is possible. This rotation is carried out about a rotational axis 19 which in the present case coincides with the aforementioned longitudinal center 16 of the housing. In this way, the other position of the components 20, 30', illustrated in FIG. 5, is reached which, in the following, is referred to as the "release position" of the emergency key for very good reasons. In this release position 30', the aforementioned positive-locking action is no longer present. The emergency key 30 can now be removed in the direction of the arrow 47 already mentioned several times. A collision of the components 20, 30' can no longer take place. The aforementioned rotation 49 can be limited by end stops 53, 54 in the interior of the receptacle 27. In the present case, the rotational angle 39 of FIG. 4 is approximately half as large as the rotational angle 48, relative to the center plane 16 of housing 20.

Figure 1:
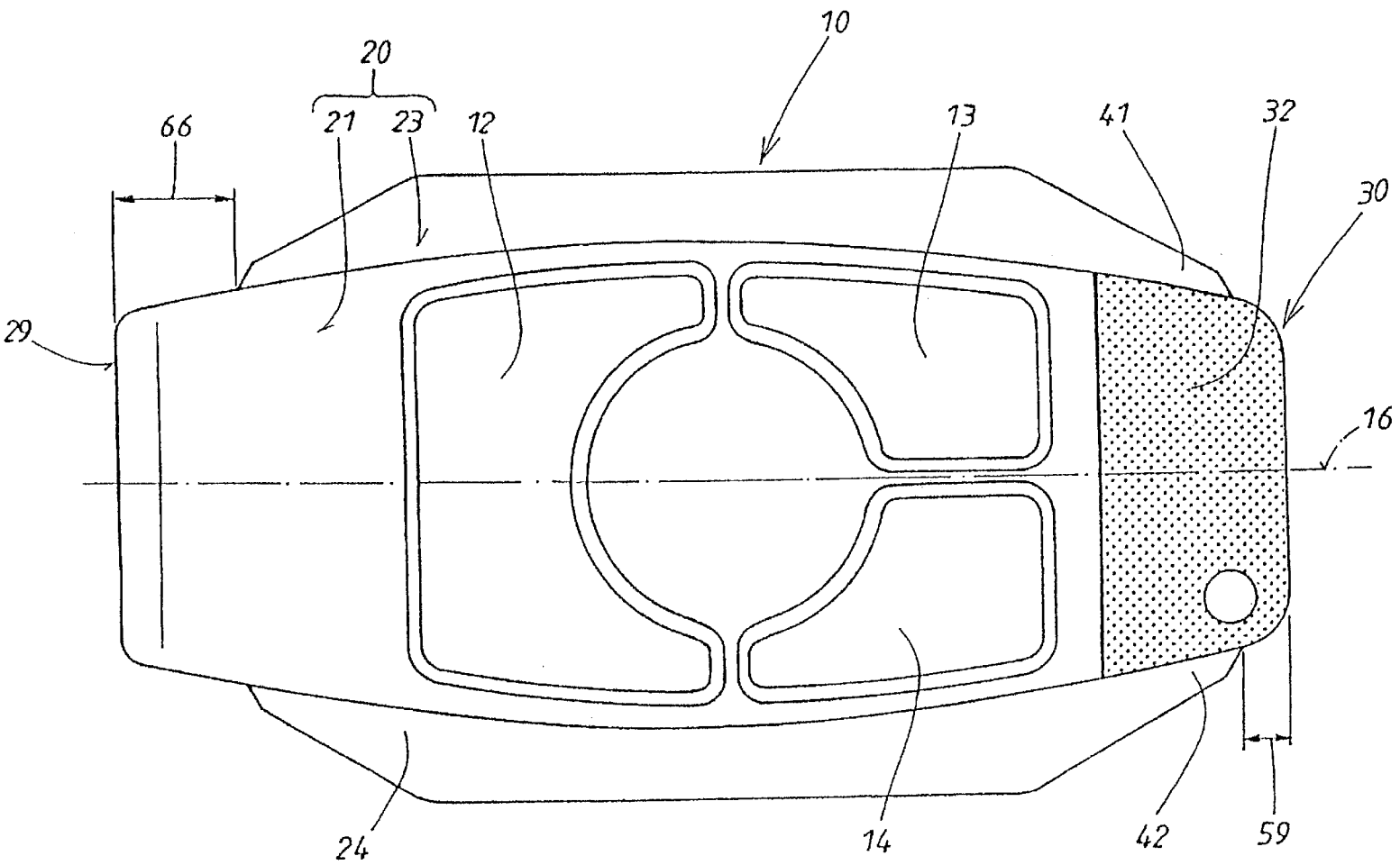
FIG. 1 a plan view onto the housing of the electronic key with inserted emergency key.
Figure 2:
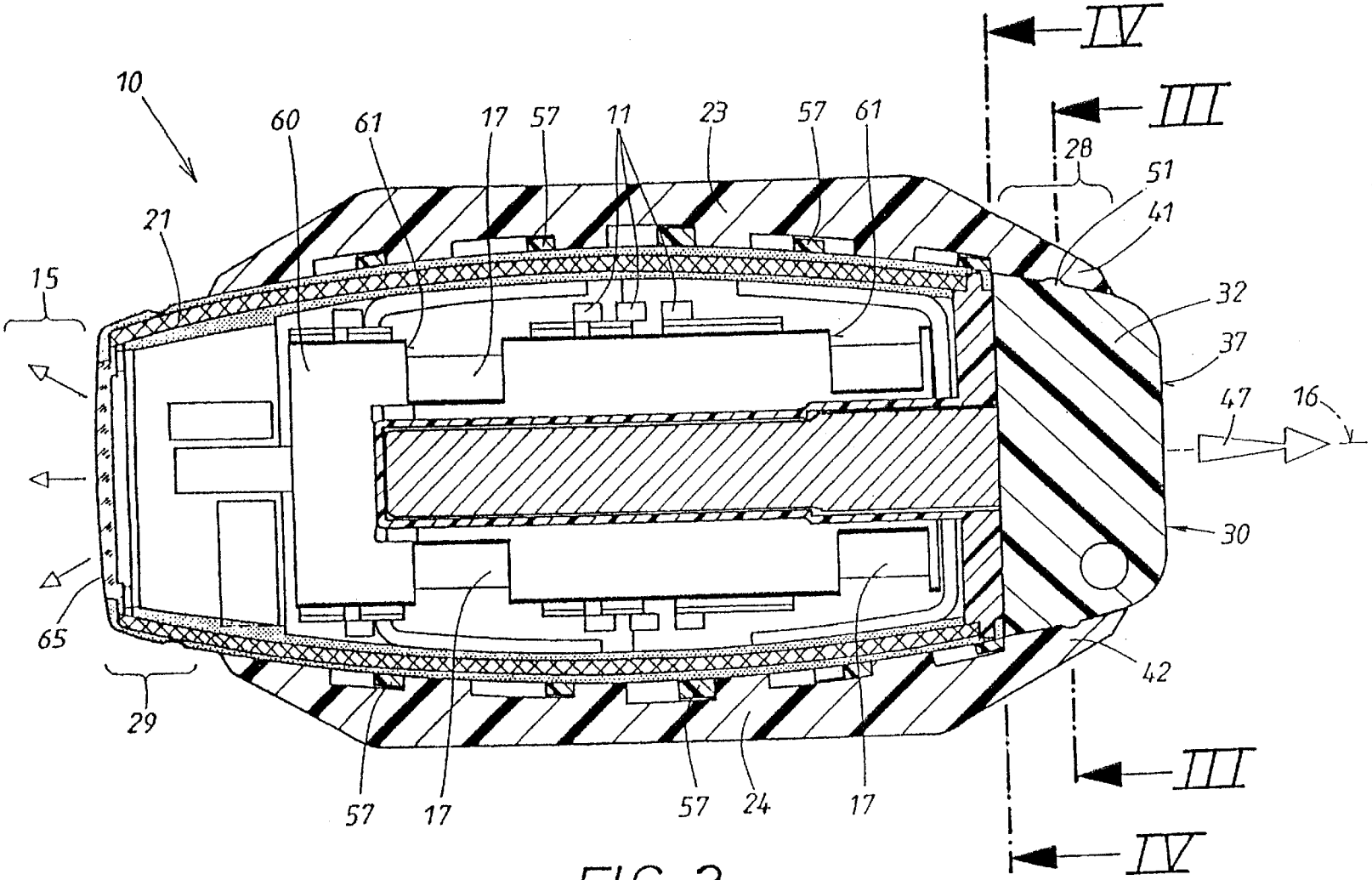
FIG. 2 schematically a longitudinal section of the housing of FIG. 1.

According to FIG. 1, the emergency key 30 is provided with a surprisingly large key head 32 which, for the purpose of clarity, is illustrated with point hatching. This provides a comfortable handling during the aforedescribed removal 47 as well as the later rotational actuation of the emergency key 30 in the lock. The key head 32 can even project with a residual piece 59 in the securing position past the outer limitation of the housing 10 at the ends of the two legs 41, 42.

The form locking action between the cutout 40 and the emergency key 40 according to the invention is thus realized by axial support and optionally by radial rotational stops in the area of the key head 32. Instead of the key head 32 widened portions of the key shaft 31 or the like can be used. It is beneficial in this connection to provide a surface contact for which reasons the aforedescribed inner surfaces 43, 44 of the two legs 41, 42 have rounded portions corresponding to the rotation 49 and come to rest with gaps as narrow as possible at a corresponding counter profile at 33, 44 of the key head 32. In the present case, the two oppositely positioned side surfaces 33, 34 of the head taper substantially linearly in the direction toward the free end 37 of the head along the auxiliary lines 35, 36 of FIG. 7. This results in a positive-locking action by surface contact between 33, 43, on the one hand, and 34, 44, on the other hand. As a result of the rotation 49 for decoupling and, as will be demonstrated, also during coupling, the engagement of the components 20, 30 in the securing position could also be effective at other locations, for example, at the free end 37 of the head. Because of the good engagement, the emergency key 30 positioned in the securing position can also not be removed by large axial forces in the direction of removal arrow 47. The emergency key is secured in its securing position 30 so reliably in the cutout 40 relative to pulling-out forces that its key head 32 can be provided without problems with a hole.56 for a key chain or the like.

The described righting movement is carried out in the reverse direction when, starting with a removed emergency key, the key is to be positioned again in the cutout of the housing 20 of FIG. 6 in the direction of the arrow 58 of FIG. 6 into the housing 20. In this case, the emergency key is first in its release position 30' external to the housing 20 and is then moved in the direction of arrow 58 of FIG. 6 into the receptacle 27 until the end position has been reached at axial stops. Now the emergency key is turned in the counter direction relative to the rotation arrow 49 into its securing position 30 of FIGS. 3 and 4.

The housing 20 is comprised of, as already mentioned, several housing parts 21 to 24. They comprise an upper shell 21 and a lower shell 22 in the central area and two side parts 23, 24. The side parts are engaged by cams 57 or the like which are seated on the upper and lower shells 21, 22 and ensure a connection of these housing parts. The cutout 40 is realized by an extension of the housing side parts 23, 24 past the end of the upper and lower shells 21, 22 so that the already mentioned fork legs 41, 42 result. The forward housing end 29 is formed by the combined upper and lower shells 21, 22 and has a blunt shape at 65 of FIG. 2. At this forward housing end 29 the two side parts 23, 24 begin at an axial spacing 66 relative to the blunt front 65.

List of reference numerals

10 electronic key
11 electronic components
12 first actuation location of 10
13 second actuation location of 10
14 third actuation location of 10
15 signal of 10
16 longitudinal direction of housing, longitudinal center
17 microswitch
18 center plane of 20, housing plane
19 rotational axis for 30 in 30'
20 housing, entire housing
21 upper shell of 20
22 lower shell of 20
23 first side part of 20
24 second side part of 20
25 quiver for 31 in 20
26 end wall of 25 between 21, 22
27 receptacle in 25 for 31
28 rearward housing of 20
29 forward housing of 20
30 emergency key (securing position; secured)
30' release position of 30
31 key shaft of 30 (securing position)
31 ' release position of 31 at 30'
32 key head of 30 (securing position)
32' release position of 32
33 counter profile for 43 on 32 (FIG. 7), first head side surface of 32
34 counter profile for 44 on 32 (FIG. 7, second head side surface of 32
35 tapering of 33
36 tapering of 34
37 free head end of 32
38 plane of the key head; center plane of 32 (in securing position, FIG. 4)
38 ' release position of 38 (FIG. 5)
39 rotational angle between 31, 38
40 cutout in 28, fork opening
41 first leg of 23, fork leg
42 second leg of 24, fork leg
43 inner surface of 41
44 inner surface of 42
45 angle of undercut of 43
46 angle of undercut of 44
47 translatory pulling-out arrow of 30'
48 rotational angle between 30, 30'
49 rotational arrow of 30
50 flat profile of 31
51 first locking element on 33, 34, projection
52 second locking element on 43, 44, depression
53 first rotational stop in 27 for 31
54 second rotational stop in 27 for 31'
55 plane of 50
56 suspending hole in 32 (FIG. 7).
57 lateral cam on 22 or 21, for 23 or 24
58 translatory arrow of insertion movement of 30' FIG. 6)
59 projecting remainder piece of 32 (FIG. 1)
60 foil in 12 and 17
61 depression in 60 for 17
62 switching member on 17 (FIG. 8)
63 plate shape of 20 (FIG. 4)
64 plate shape form of 32 (FIG. 4
65 blunt front of 29
66 axial spacing of 23, 24 relative to 29 (FIG. 1)

What is claimed is:

1. Electronic key (10), in particular, for motor vehicles, comprising a housing (20) configured to receive electronic components (11) configured to send or receive signals (15) and to activate a corresponding electronic or electromechanical lock, and comprising a mechanical emergency key (30) which is insertable with a key shaft (31) into a receptacle (27) of the housing (20), wherein the receptacle is a blind hole and the key shaft (31) is insertable in an axial direction of the blind hole, and is secured in the insertion situation in the housing, wherein the emergency key (30), when in use, is axially completely removed from the blind hole and is separated from the housing (20), wherein the emergency key (30) is provided with a widened portion (32) located externally to the blind hole in the insertion situation, wherein a securing action for the emergency key (30) in the insertion situation is generated by a positive locking action between the widened portion (32) and the housing (20) realized in that one housing end (28) has a cutout (40) which is undercut (45, 46) at least over portions thereof and normally, with the emergency key (30) inserted, prevents an axial pulling-out movement (47) of the emergency key (30), wherein the key head in the insertion situation is positioned inside the housing (20) in a substantially positive-locking securing position (30), and the emergency key in the blind hole of the housing (20) is rotatable is rotatable about a longitudinal axis of the key shaft out of the securing position (30) into a release position (30') in which the positive locking action between the widened portion (32') and the cutout (40) is released in a direction of the axial pulling-out movement (47) of the emergency key.

2. Key according to claim 1, wherein the widened portion in the emergency key (30) is comprised of the grip for key actuation, such as a key head (32).

3. Key according to claim 1, wherein the cutout (40) is delimited at least on one side thereof by a leg (41, 42) and the leg (41, 42) has the undercut (45, 46) at the inner flank (43, 44) facing the cutout (40)

and wherein the key head (32) tapers, at least over portions thereof, with its head side surface (33, is 34) facing the inner flank (43, 44) of the housing leg (41, 42) toward the free head end (37) and, in the securing position (30) of the emergency key, is supported at least with portions thereof on the housing leg (41, 42).

4. Key according to claim 1, wherein the key head (32) and the housing (20) are plate-shaped (63, 64) wherein the plate-shape defines two center planes (18, 38), respectively, and wherein the center planes (18, 38) are substantially aligned with one another in the securing position but the two planes (18, 38') are rotationally displaced (48) relative to one another in the release position.

5. Key according to claim 1, wherein between the key head (32) and the cutout (40) in the housing (30) locking elements are arranged which secure the securing position (30) with respect to axial rotations (49) of the emergency key (30).

6. Key according to claim 1, wherein axial rotational stops (53, 54) are provided in the blind hole of the housing and determine the position of the key shaft in the securing position (31) and/or the release position (31') and limit the axial rotation (49) of the key shaft between these two positions (31, 31').

7. Key according to claim 1, wherein the key shaft (31) has a flat profile (50), wherein the key head (32) of the emergency key (30) has a preferably symmetrical cross-sectional profile which determines the center plane (38) in the key head (32), and wherein the plane (55) of the flat profile (50) of the key shaft (31) is positioned at a rotational angle (39) relative to the center plane (38) in the key head (32) relative to the rotational axis (19), wherein the rotational angle (39) determines the axial rotation (49) of the emergency key between the securing position (30) and the release position (30').

8. Key according to claim 7, wherein the rotational angle (39) between the flat profile plane (55) of the key shaft (31) and the center plane (38) of the key head (32) is substantially identical to half the rotational angle (48) of the key shaft between its rest position (31) and the release position (31').

9. Key according to claim 1, wherein the blind hole for the key shaft (31) in the housing is comprised of a quiver (25) of an inner housing.

10. Key according to claim 9, wherein the inner housing, provided with the quiver (25), is arranged between an upper shell (21) and a lower shell (22) of a multi-part housing (20).

11. Key according to claim 1, wherein the leg (41, 42) of the cutout (40) is formed of the end piece of a housing side part (23) or (24) generating the longitudinal edge of the housing (20).

12. Key according to claim 11, wherein lateral cams (57) or the like connect the upper and lower shells (21, 22) of the housing (20) with the housing side part or parts (43, 24).

13. Key according to claim 1, wherein the receptacle (27) is arranged substantially in the longitudinal center (16) of the housing (20)

and that the longitudinal center (16) determines a symmetry axis of the housing (20).

14. Key according to claim 1, wherein the rearward housing end (28) is forked (40) and wherein the cutout in the housing (20) is comprised of a fork opening (40) which is surrounded on both sides by two fork legs (41, 42) delimiting it.

15. Key according to claim 14, wherein the two fork legs (41, 42) at their facing inner flanks (43, 44) comprise oppositely oriented undercuts (45, 46), respectively, for the key head (32) of the emergency key (30).

16. Key according to claim 1, wherein the electronic components (11) are located on a foil (60) serving as a flexible circuit board and wherein—viewed in cross-section—this foil (60) extends in a C-shaped curvature about the blind hole extending in the longitudinal direction (16) of the housing.

17. Key according to claim 16, wherein the foil (60) has depressions (61) at some locations thereof in which micro switches (17) having switching members (62) are positioned and wherein the switching members (62) of the micro switches (17), when the foil (60) is curved, are aligned with the actuating locations (12, 13, 14) on the outer side of the housing (20).

* * * * *